United States Patent [19]

Sawayama et al.

[11] 4,099,781

[45] Jul. 11, 1978

[54] APPARATUS FOR AUTOMATICALLY SHIFTING THE CONVEYOR AT THE PIT FACE IN THE COAL MINE

[75] Inventors: Isao Sawayama; Hajime Endo, both of Kushiro, Japan

[73] Assignee: Taiheiyo Engineering Incorporated, Tokyo, Japan

[21] Appl. No.: 784,750

[22] Filed: Apr. 5, 1977

[30] Foreign Application Priority Data

Sep. 22, 1976 [JP] Japan ..... 51-114053

[51] Int. Cl.[2] ..... E21C 35/08

[52] U.S. Cl. ..... 299/1

[58] Field of Search ..... 299/1

[56] References Cited

U.S. PATENT DOCUMENTS

| | | | |
|---|---|---|---|
| 3,320,001 | 5/1967 | Allen et al. | 299/1 |
| 3,489,460 | 1/1970 | Cooper | 299/1 |
| 3,826,535 | 7/1974 | Fujimori et al. | 299/1 |

FOREIGN PATENT DOCUMENTS

| | | | |
|---|---|---|---|
| 1,100,464 | 1/1968 | United Kingdom | 299/1 |

*Primary Examiner*—Ernest R. Purser

*Attorney, Agent, or Firm*—Frank J. Jordan

[57] ABSTRACT

Apparatus employed at the long-walled pit face in the coal mine so as to shift the conveyor toward the pit face wherein the conveyor which is arranged in front of the pit face and on which the shearer travels, is divided into several individual portions, and responding to signals transmitted from a position sensor arranged in each portion of the conveyor, a position signal generator attached to the shearer and a stroke sensor attached to one of hydraulic cylinders belonging to each portion on the conveyor, a group of electromagnetic valves for rendering operative the hydraulic cylinders which belong to that portion of the conveyor to be shifted are controlled so as to shift automatically when required only the corresponding portion of the conveyor.

3 Claims, 1 Drawing Figure

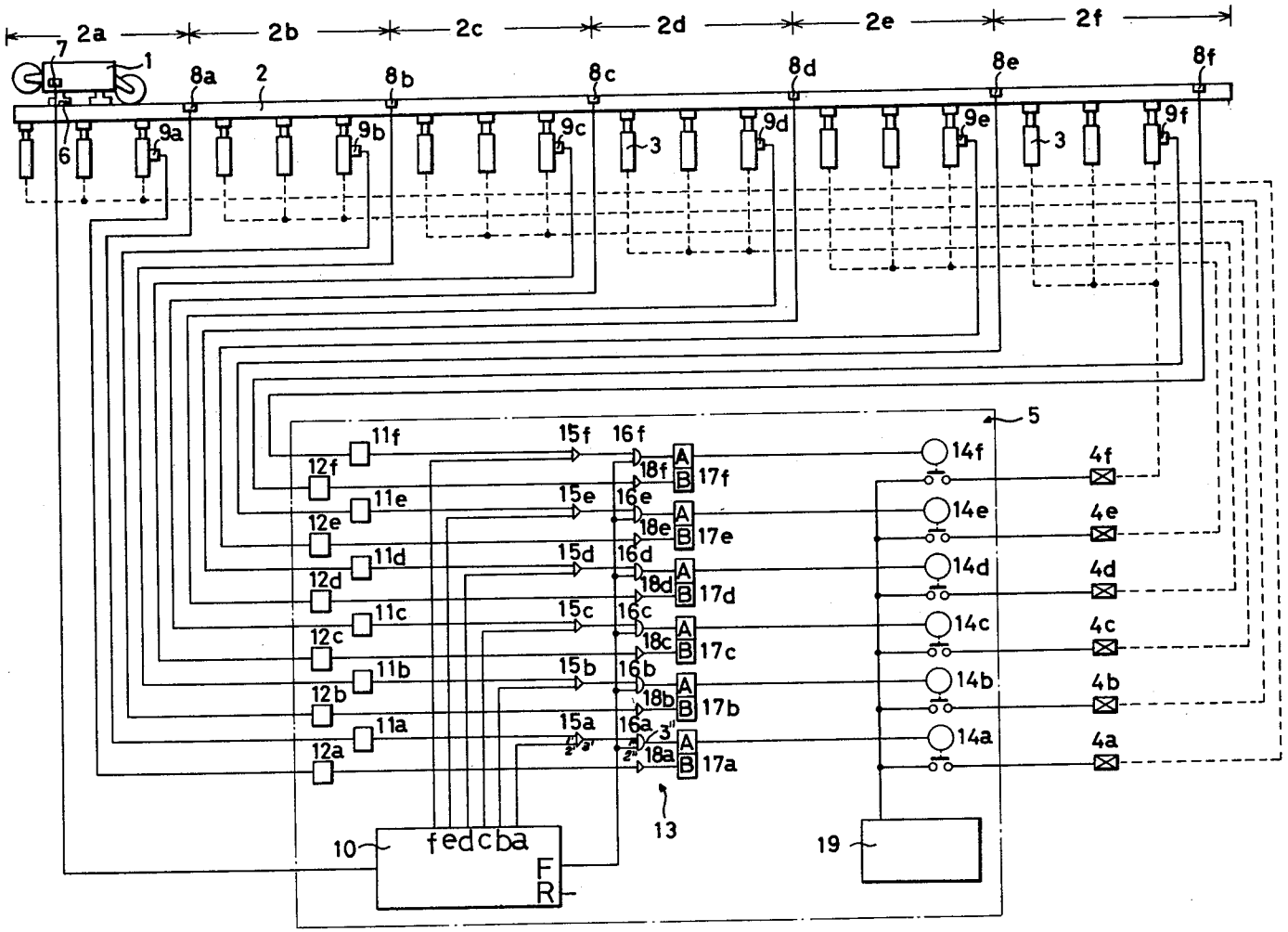
2a
2b
2c
2d
2e
2f
1
2
3
4a
4b
4c
4d
4e
4f
5
6
7
8a
8b
8c
8d
8e
8f
9a
9b
9c
9d
9e
9f
10
11a
11b
11c
11d
11e
11f
12a
12b
12c
12d
12e
12f
13
14a
14b
14c
14d
14e
14f
15a
15b
15c
15d
15e
15f
16a
16b
16c
16d
16e
16f
17a
17b
17c
17d
17e
17f
18a
18b
18c
18d
18e
18f
19
A
B
F
R
fedcba

APPARATUS FOR AUTOMATICALLY SHIFTING THE CONVEYOR AT THE PIT FACE IN THE COAL MINE

The present invention relates to apparatus for automatically shifting the conveyor on which a coal mining machine such as a ranging drum shearer travels at the long-walled pit face in a coal mine.

In case the long-walled pit face is mechanically sheared by the coal mining machine such as the ranging drum shearer, the conveyor positioned in front of the pit face which has been already sheared by the shearer must be shifted toward the pit face to cause the shearer to be ready for a subsequent shearing operation. The shift of the conveyor has been conventionally carried out by an operator who stands adjacent to the conveyor to be shifted. However, because the operator was subjected to coal dust impaired his health, the shift of the conveyor could not be carried out immediately after the shearing operation of the shearer had been finished, so that the capacity of the shearer could not be utilized to its utmost, thus lowering its coal mining efficiency and thereby causing the coal mining cost to be increased.

The present invention is intended to eliminate the above-mentioned drawbacks.

It is, therefore, a primary object of the present invention to provide an apparatus for quickly and automatically shifting that individual portion of the conveyor which is positioned in front of the pit face which has just been sheared by the shearer, so that the coal mining efficiency of the shearer thereby enhanced. Another object of the present invention is to provide an apparatus for automatically shifting the conveyor, said apparatus being intended to fully protect the operators health.

These and other objects as well as the merits of the present invention will be apparent from the following detailed description with reference to the accompanying drawing.

The drawing is a block diagram showing an embodiment of the present invention.

In the drawing numeral 1 represents a shearer, 2 a conveyor, 3 hydraulic cylinders for shifting the conveyor, 4*a* – 4*f* electromagnetic valves and 5 a group of controllers. The shearer 1 reciprocates on the conveyor 2 to shear the pit face and is provided with a magnet 6 and a signal generator 7. The conveyor 2 is divided into individual portions 2*a* – 2*f*. Each portion of the conveyor 2 is also individually controlled and provided with a position sensor 8*a* – 8*f*. One of the hydraulic cylinders 3 for shifting the conveyor 2 and belonging to a corresponding portion of the conveyor 2 is provided with a stroke sensors 9*a* – 9*f*.

The controllers 5 serve to close or open the electromagnetic valves 4*a* – 4*f* responding to the signals applied from the position signal generator 7, the position sensors 8*a* – 8*f* and the stroke sensors 9*a* – 9*f*, and comprise a counter circuit 10, receiving circuits 11*a* – 11*f* and 12*a* – 12*f*, a logic circuit 13 and relays 14*a* – 14*f*.

The counter circuit 10 serves to count the pulse signals applied from the position signal generator 7, which is attached to the shearer 1, and to generate an output signal through one of its outputs *a* – *f* when the magnet 6 attached to the shearer 1 comes near any one of the position sensors 8*a* – 8*f* which are attached to the conveyor 2.

Further, the counter circuit 10 serves to detect the direction in which the shearer 1 travels responding to the signals applied from the position signal generator 7, and to send an output signal through its output terminal *f* when the shearer 1 travels from the portion 2*a* of the conveyor 2 to the portion 2*b* thereof.

The receiving circuits 11*a* – 11*f* detect the position of the shearer 1. Namely, when the magnet 6 attached to the shearer 1 comes near any one of the position sensors 8*a* – 8*f* attached to the conveyor 2, the receiving circuits 11*a* – 11*f* detect the approach of the magnet 6 and send a signal to the logic circuit 13.

The receiving circuits 12*a* – 12*f* serve to receive the outputs applied from the stroke sensor 9*a* – 9*f* which are attached to the hydraulic cylinders 3 for shifting individual conveyor portion 2*a* – 2*f*, and to transmit the outputs to the logic circuit 13. The stroke sensors 9*a* – 9*f* detect whether or not the piston rods of the hydraulic cylinders 3 belonging to any one portion of the conveyor 2 are extended by a certain stroke to finish the shift of the portion of the conveyor 2, and when they detect it, they transmit a signal to the logical circuit 13.

Responding to the input signals applied from the counter circuit 10, the receiving circuits 11*a* – 11*f* and 12*a* – 12*f*, the logic circuit 13 serves to render the relays 14*a* – 14*f* operative to close or open the electromagnetic valves 4*a* – 4*f*. *When circuits 15a* – 15*f* receive either or both of input signals which are transmitted from the position sensors 8*a* – 8*f* through the receiving circuits 11*a* – 11*f* and from the ounter circuit 10, they generate an output which is applied to circuits 16*a* – 16*f*. On the other hand, the counter circuit 10 applies an output to the circuits 16*a* – 16*f* and therefore, when one of the circuits 16*a* – 16*f* receives, as its inputs, these outputs applied from the circuits 15*a* – 15*f* and from the counter circuit 10, it generates an output which is applied, as an input, to a section of circuits 17*a* – 17*f*. Circuits 18*a* – 18*f* transmit to a section B of the circuits 17*a* – 17*f*, a signal transmitted from one of the stroke sensors 9*a* – 9*f* through a corresponding one of the receiving circuits 12*a* – 12*f*. When an input is present in the section A of the circuits 17*a* – 17*f*, the circuits 17*a* – 17*f* render the relays 14*a* – 14*f* operative, while when an input is present in the section B of the circuits 17*a* – 17*f*, the circuits 17*a* – 17*f* render the relays 14*a* – 14*f* inoperative.

The relays 14*a* – 14*f* serve to break either or establish a connection between a power source 19 and the electromagnetic valves 4*a* – 4*f* responding to the operation of the circuits 17*a* – 17*f*.

Taking an example in which the shearer 1 travels on the conveyor 2 from portion 2*a* to portion 2*b*, the apparatus of the present invention operates, as follows: As the shearer 1 starts to travel, shearing the pit face, on the conveyor 2 from portion 2*a* to portion 2*b*, the direction in which the shearer 1 travels is detected by the counter circuit 10 and at the same time the counter circuit 10 applies through its output terminal F a signal to the terminal 2″ of the circuit 16*a* of the logic circuit 13. When the shearer 1, still shearing the pit face, comes into the portion 2*b* of the conveyor 2 and therefore, the sheering operation of the pit face corresponding to the portion A thereof is finished, the magnet 6 attached to the shearer 1 approaches the position sensor 8*a* attached to the conveyor 2, causing the counter circuit 10 to apply from its output terminal *a* an output signal to an input terminal 2′ of the circuit 15*a*. At the same time, a signal is transmitted, as an input, from the position sensor 8*a* to an input side 1 of the circuit 15*a*. When the circuit 15*a* receives these inputs through its input terminal 1′ and 2′, the circuit 15*a* applies through its output 3′ an output to an input side 1 of the circuit 16*a*. As the circuit 16*a* receives these inputs through its input terminals 1' and 2', the circuit 16*a* generates an output signal which is applied through its output terminal 3' to the section A of the circuit 17*a*, thus causing the relay 14*a* to be operated. As a result, a connection is established between power source 19 and the electromagnetic valve 4*a* to thereby render the electromagnetic valve 4*a* operative, so that the hydraulic cylinders 3 belonging to the portion *a* of the conveyor 2 are made operative to shift the portion 2*a* of the conveyor 2 toward the pit face.

When the piston rods of these hydraulic cylinders 3 are extended by a certain stroke, the stroke sensor 9*a* is made operative to generate a signal, which is detected by the receiving circuit 12*a* and then transmitted through the circuit 18*a* to the section B of the circuit 17*a*. When the section B of the circuit 17*a* receives this input, the output at the section A side thereof is made zero to render the relay 14*a* inoperative, to breaking the connection between the power source 19 and the electromagnetic valve 4*a*, and stopping the operation of the hydraulic cylinders 3. Thus, the shift of the conveyor 2 corresponding to the portion A thereof is finished. The repetition of the operations as stated above thus causes every portion of the conveyor 2 to be progressively and automatically shifted toward the pit face as the shearer 1 travels on the conveyor 2.

Though the position sensors 8*a* – 8*f* are put "ON" or "OFF" by the magnetic action of the magnet 6 in the described embodiment of the present invention, it will be understood that they may be manually put "ON" or "OFF" or by mechanical switches which are rendered operative when the shearer 1 passes by any one of the position sensors 8*a* – 8*f*.

Being constructed and functioned as described above, the apparatus of the present invention for automatically shifting portions of the conveyor toward the pit face allow the operator to remotely operate the apparatus protecting him from coal dust, so that the coal mining efficiency is greatly enhanced for greater productivity.

What is claimed is:

1. An apparatus for automatically shifting individual conveyor portions toward a long-walled pit face in a coal mine as a shearer on the conveyor progresses from one portion to another, comprising a position sensor arranged in each portion of the conveyor, a position signal generator attached to said shearer, a set of hydraulic cylinders associated with each individual portion of the conveyor, a stroke sensor attached to each set of said cylinders, and control circuit means including a group of electromagnetic valves which act to render operative the set of hydraulic cylinders belonging to each individual portion of the conveyor to be shifted responding to signals transmitted from the position sensor, the position signal generator and the stroke sensor, whereby only that individual portion of the conveyor corresponding to the portion of the pit face which has been already sheared by the shearer is progressively and automatically shifted toward the pit face by the corresponding set of hydraulic cylinders.

2. An apparatus for automatically shifting individual conveyor portions toward a long-walled pit face in a coal mine as defined by claim 1, wherein each of the position sensors comprises a magnet.

3. An apparatus for automatically shifting individual conveyor portions toward a long-walled pit face in a coal mine as defined by claim 1, wherein each of the position sensors which the shearer passes is put "ON" or "OFF" by a mechanically actuated switch.

* * * * *